US005170742A

United States Patent [19]

Roskelley

[11] Patent Number: 5,170,742

[45] Date of Patent: Dec. 15, 1992

[54] DAVIT WITH LOW LEVEL OF DYNAMICISM

[75] Inventor: Douglas E. Roskelley, Woodinville, Wash.

[73] Assignee: Samuel F. Olsson, Woodinville, Wash.

[21] Appl. No.: 861,640

[22] Filed: Apr. 1, 1992

[51] Int. Cl.[5] ..... B63B 23/02

[52] U.S. Cl. ..... 114/366; 114/44; 114/373

[58] Field of Search ..... 114/44, 258, 259, 365, 114/366, 369, 371, 373; 212/262; 414/678

[56] References Cited

U.S. PATENT DOCUMENTS 4,364,326 12/1982 Pike ..... 114/373
4,864,951 9/1989 Koepp ..... 114/366
4,964,358 10/1990 Sandrow ..... 114/365

*Primary Examiner*—Edwin L. Swinehart
*Assistant Examiner*—Clifford T. Bartz
*Attorney, Agent, or Firm*—Christopher Duffy

[57] ABSTRACT

The davit 10 has an arm structure 16 with an indentation 44 therein within which it "hugs" the object 14 suspended from the same so as to reduce the objects's dynamicism on the mother vessel 2 when the vessel is underway and reacting to the water. This follows from the fact that in the relatively retracted position of the arm structure (FIGS. 1 and 2), wherein the object is stored until there is a need for it, the recess 48 of the indentation is disposed substantially entirely on the relatively inboard side of the vertical plane of the horizontal axis 40 about which the arm structure is pivotally mounted, and the object is suspended from the arm structure so that the relatively inboard side 24 of the object crosses the vertical plane of the axis and advances within the recess to locate the center of gravity of the object in more of a dead center relationship with that of the davit.

20 Claims, 2 Drawing Sheets

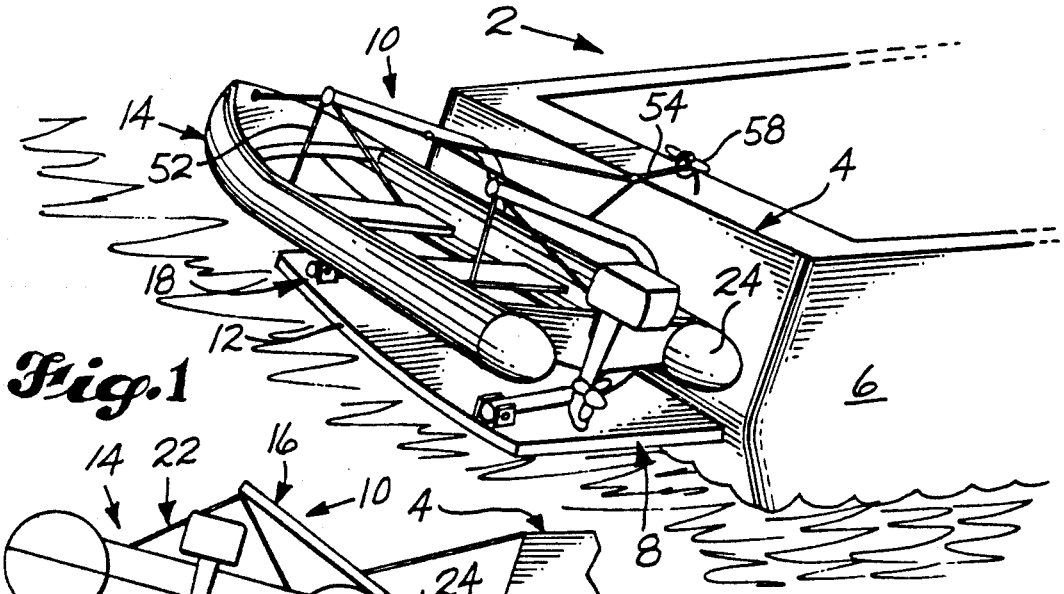
Fig. 1
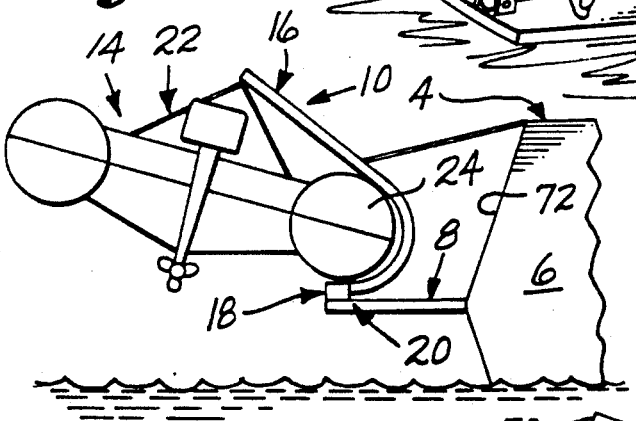
Fig. 2
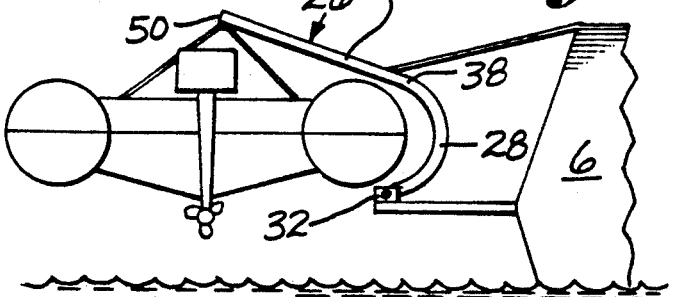
Fig. 3
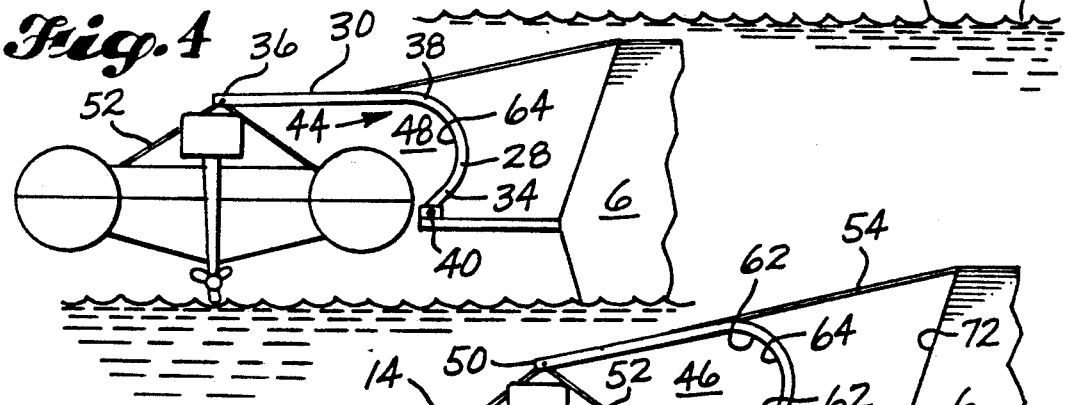
Fig. 4
Fig. 5

DAVIT WITH LOW LEVEL OF DYNAMICISM

DESCRIPTION

1. Technical Field

The present invention relates to a davit for a marine vessel, and particularly, a davit which "hugs" the object suspended from the same so as to reduce the object's dynamicism on the vesel when the vessel is underway and reacting to the water.

2. Background Art

On marine vessels, certain objects such as pieces of cargo, anchors, accommodation ladders and dinghies or other auxiliary vessels, are commonly suspended from davits and each stored in a relatively raised position on the davit until there is a need for the object, whereupon the object is lowered into use. The davit may be fixed in place on the vessel, so that the user must rely on a block and tackle to raise and lower the object; or the davit may be pivotally mounted on the vessel so that the user can swing it up and down to raise and lower the object. Commonly, the davit is mounted on a generally horizontal surface of the vessel, adjacent an edge thereof, and operatively projected relatively outboard from the edge to raise and lower the object between positions relatively above and below the surface. A dinghy or other auxiliary vessel, for example, is commonly raised to a level at or above the transom of the mother vessel, and then stored in that position until it is needed again on the water, whereupon it is lowered into use.

Of course, every such object has a center of gravity, and because of the very nature of a davit, the center of gravity of the object is located well outboard of the point at which the davit is mounted on the surface of the vessel, and accordingly, is prone to generate a substantial moment of force around the base of the davit. This in turn generates a dynamic load on the davit, and indeed on the mother vessel itself, when the mother vessel is underway and reacting with the water, such as when it reacts with waves in the water.

DISCLOSURE OF THE INVENTION

The inventive davit "hugs" the object suspended from it, so as to reduce the object's dynamicism on the vessel when the vessel is underway and reacting with the water. It is adapted, therefore, to be employed with an object having a suitable configuration for this purpose, and more particularly, an object having one laterally oriented side thereof adapted to be accommodated within an indentation in the peripheral outline of the davit, when the object is raised to a predetermined level above the surface of the vessel and suspended from the davit in a generally horizontal disposition with the one laterally oriented side thereof oriented toward the davit.

The davit itself comprises an elongated crane-like arm structure, a base for supporting the arm structure on the surface of the vessel to pivot about an arc in the vertical plane coinciding with the longitudinal axis of the arm structure, a stop for defining one end of the arc of pivotal movement of the arm structure in the aforesaid vertical plane of the longitudinal axis thereof, and a bridle which is operable when the arm structure is at the one end of the arc, to suspend the object from the arm structure at the aforesaid level above the surface of the vessel, and in a generally horizontal disposition in which the one laterally oriented side of the object is oriented toward the arm structure transverse the plane of pivotal movement of the arm structure. More particularly, the arm structure has a pair of first and second sections in the body thereof, which are relatively tandemly arranged along the length of the arm structure and disposed adjacent the opposing ends of the arm structure, with a juncture therebetween intermediate the ends of the arm structure. The first body section is disposed adjacent one end of the arm structure, and the one end portion of the arm structure is pivotally connected to the base so that the first body section is pivotable about a generally horizontal axis trans-verse the aforesaid vertical plane of the longitudinal axis of the arm structure. The stop, meanwhile, is operatively disposed to limit the pivotal travel of the first body section to a relatively retracted position in which the first body section coincides with the perpendicular interconnecting the stop with the horizontal axis at one side of the vertical plane coinciding with the horizontal axis. The first body section has a relatively concave swale therein, the mouth of which is oriented toward the other side of the vertical plane of the horizontal axis, and the recess of which is disposed within the peripheral outline of the arm structure to lie substantially entirely on the one side of the vertical plane of the horizontal axis and form the indentation in the peripheral outline of the davit when the first body section of the arm structure is disposed in the relatively retracted position thereof. The second body section, meanwhile, is cantilevered relatively rigidly outwardly from the first body section at the juncture between the respective body sections, so that the second body section extends outwardly from the first body section substantially along a line of projection that forms an acute angle with the perpendicular interconnecting the stop with the horizontal axis, and projects to the other side of the vertical plane of the horizontal axis from the one side thereof to the extent that the other end of the arm structure is disposed on the other side of the vertical plane of the horizontal axis when the first body section is in the relatively retracted position thereof. The bridle is suspended from the other end portion of the arm structure at a point in the plane of pivotal movement thereof sufficiently spaced apart from the horizontal axis that the aforesaid one laterally oriented side of the object remains spaced apart from the vertical plane of the horizontal axis and on the other side thereof, when the object is suspended on the bridle at the aforesaid level and in the aforesaid disposition, and the first body section is pivoted in an arc about the horizontal axis between positions in which the line of projection of the second body section coincides with a horizontal in the plane of pivotal movement, and inclines to the same at angles therebelow, respectively, but the aforesaid one laterally oriented side of the object crosses the vertical plane of the horizontal axis and alternately advances within and retracts from the recess of the swale in the first body section when the first body section is pivoted in the arc about the horizontal axis between positions in which the line of projection of the second body section coincides with the aforesaid horizontal in the plane of pivotal movement, and inclines to the same at angles thereabove, respectively. This enables the center of gravity of the object to be brought into more of a dead center relationship with the center of gravity of the davit when the arm structure is pivoted into the relatively retracted position thereof.

Preferably, the point of suspension of the bridle is spaced apart from the horizontal axis so that the one laterally oriented side of the object abuts the first body section of the arm structure at the swale thereof when the arm structure is in the relatively retracted position thereof. The arm structure itself may also abut a second surface of the vessel which is relatively upstanding on the first mentioned surface of the vessel, at a distance from the horizontal axis, when the one side of the object abuts the first body section of the arm structure in the relatively retracted position thereof.

In certain of the presently preferred embodiments of the invention, the swale has a generally U-shaped cross section in the plane of pivotal movement of the arm structure, and generally opposing walls at the opposing sides of the recess of the swale, and the sidewalls of the swale are spaced apart from one another in the plane of pivotal movement by an intermediate wall at the bight of the U which corresponds in width to the height of the one side of the object so that the one side of the object substantially mates with both sidewalls of the swale when the one side of the object is advanced within the recess of the swale. In other presently preferred embodiments of the invention, the sidewalls of the swale are spaced apart from one another in the plane of pivotal movement by an intermediate wall at the bight of the U which is substantially wider than the height of the one side of the object so that the one side of the object tends to mate more with one sidewall of the swale than the other, when the one side of the object is advanced within the recess of the swale.

In many of the presently preferred embodiments of the invention, the arm.structure is also elongated along a parallel to the horizontal axis, to coextend with an object, such as a dinghy, which is elongated along a parallel to the horizontal axis. The bridle includes a set of crotch lines which are attachable to the opposing end portions of the object, at points spaced apart from the aforesaid point of suspension, to suspend the object in a generally horizontal disposition from the arm structure.

In certain embodiments, the arm structure comprises a pair of crooked arms which have first and second body sections apiece and are interconnected with one another in spaced parallel array at the opposing axial ends of the arm structure. The first and second body sections of each arm form a general L-shaped configuration in which the first body section is crooked to have a generally U-shaped configuration, and the second body section is generally straight to give the respective arm the necessary reach. The base, meanwhile, comprises a pair of spaced parallel shoes which have the first body sections of the respective arms pivotally interconnected therewith at a horizontal axis extending therebetween, and stops formed on the heels thereof at points spaced apart from the horizontal axis.

In one particular use of the davit, the shoes are mounted on a swim platform extending across the stern of a yacht-like vessel, below the transom thereof, and the arm structure is swung inboard and outboard of the transom by means of a line extending outboard from the transom to a cross member bridging between the pair of arms at the axial ends of the arm structure. The line may be power operated or simply wrapped about a cleat and hand operated when it is desired to raise or lower the arm structure, say, for purposes of storing an auxiliary vessel thereon.

BRIEF DESCRIPTION OF THE DRAWINGS

These features will be better understood by reference to the accompanying drawings wherein one emboidment of the inventive davit is illustrated in use on such a swim platform, the auxiliary vessel taking the form of a monohull-type dinghy, one pontoon of which is adapted to nest within the indentation of the davit in the relatively retracted position thereof.

In the drawings:

FIG. 1 is a part perspective view of the stern of the yacht showing the swim platform projecting therefrom and the davit mounted thereon, with the adjacent pontoon of a monohull-type dinghy nested within the indentation of the davit, in the relatively retracted position of the same;

FIG. 2 is a part side elevational view of the stern of the yacht, and the platform, davit and dinghy, when the davit has been tethered to the transom in the relatively retracted position thereof, with the adjacent pontoon of the dinghy nested within the indentation thereof;

FIG. 3 is a similar side elevational view of the assembly when the davit has been untethered and allowed to pivot in the direction outboard from the transom to lower the dinghy toward the water;

FIG. 4 is a third such side elevational view of the assembly when the davit has been allowed to pivot still further into a generally horizontal disposition;

FIG. 5 is a fourth such view when the davit has been allowed to pivot below the horizontal sufficiently to place the dinghy on the water;

BEST MODE FOR CARRYING OUT THE INVENTION

Figure 6:
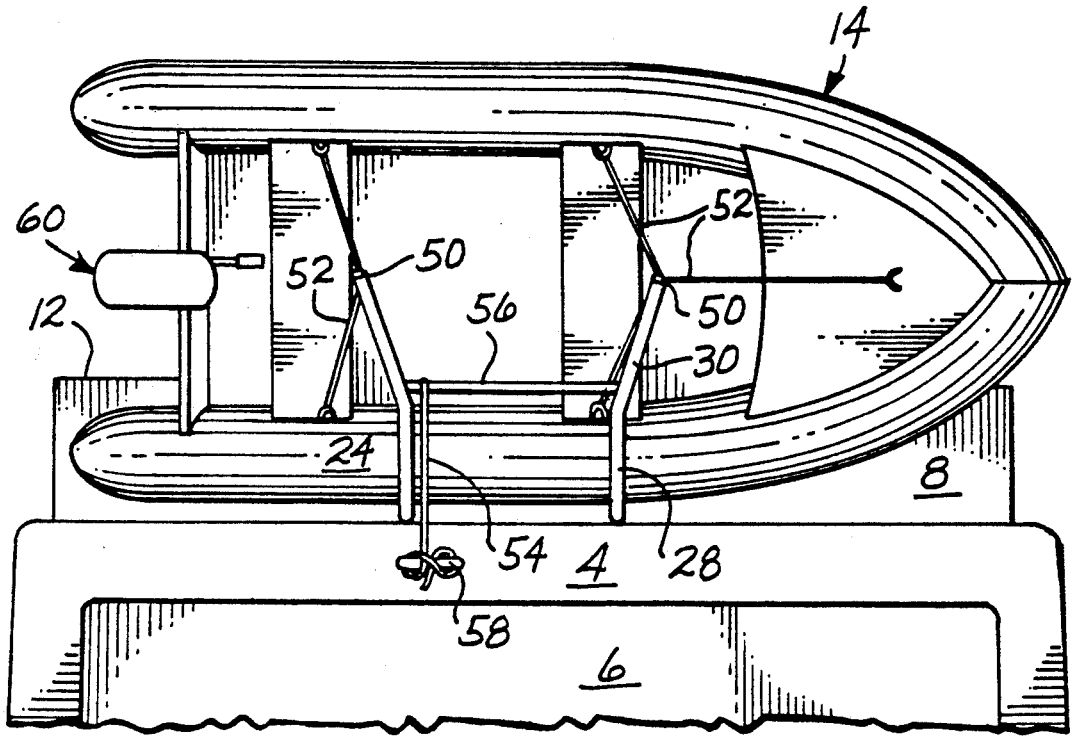
FIG. 6 is a top plan view of the assembly when the davit is in the relatively retracted position thereof, with the adjacent pontoon of the dinghy nested within the indentation thereof.

Referring first to FIGS. 1–6, it will be seen that the yacht 2 has a transom 4 across the stern 6 thereof, and a generally horizontal swim platform 8 projecting rearwardly therefrom at a level below the transom. The davit 10 is mounted on the top surface of the platform, adjacent the aft edge 12 thereof, to be operatively projected relatively outboard of the edge, for purposes of raising and lowering a monohull-type dinghy 14 between positions above and below the platform. The davit 10 comprises an elongated crane-like arm structure 16, a base 18 for supporting the arm structure 16 on the surface of the platform 8 to pivot about an arc in the vertical plane coinciding with the longitudinal axis of the arm structure, a stop 20 for defining the relatively inboard end of the arc of pivotal movement of the arm structure 16 in the aforesaid vertical plane of the longitudinal axis thereof, and a bridle 22 which is operable when the arm structure 16 is at the relatively inboard end of the arc, to suspend the dinghy 14 from the arm structure at a level above the surface of the platform and in a generally horizontal disposition in which the relatively inboard pontoon 24 of the dinghy is oriented toward the arm structure transverse the plane of pivotal movement of the arm structure.

Like the dinghy itself, the arm structure 16 is elongated along a parallel to the transom 4, and comprises a pair of crookstaff-shaped arms 26 which have two body sections 28 and 30 apiece, and are pivotally interconnected with a pair of shoes 32 that are arranged in spaced parallel array with one another on the surface of the platform 8 at the opposing laterally oriented ends of the arm structure. The respective body sections 28 and 30 of the arms are relatively tandemly arranged along the lengths of the respective arms and disposed adjacent the opposing relatively inboard and outboard ends 34 and 36 of the arms, with a juncture 38 therebetween intermediate the relatively inboard and outboard ends of the arms. The first body sections 28 of the arms outboard from the surface of the platform, are disposed adjacent the relatively inboard ends 34 of the arms, and the relatively inboard end portions 34 of the arms are pivotally connected to the corresponding shoes 32 so that the relatively inboard first body sections 28 of the arms are pivotal about a horizontal axis 40 transverse the vertical planes of the longitudinal axes of the arms. However, the shoes 32 have stops 42 on the heels thereof, which are operatively disposed to limit the pivotal travel of the respective inboard body sections 28 of the arms to a relatively retracted position in which the inboard body sections 28 coincide with those perpendiculars interconnecting the stops with the horizontal axis 40 at the relatively inboard side of the vertical plane coinciding with the horizontal axis. See FIGS. 1 and 2. Meanwhile the relatively inboard body sections 28 of the arms have relatively concave swales 44 therein, the mouths 46 of which are oriented toward the relatively outboard side of the vertical plane of the horizontal axis 40 and the recesses 48 of which are disposed within the peripheral outlines of the arms to lie substantially entirely on the relatively inboard side of the vertical plane of the horizontal axis 40 and form the indentation in the peripheral outline of the davit when the relatively inboard body sections 28 of the arms are in the relatively retracted position of the arm structure. See FIG. 2. Moreover, the relatively outboard second body sections 30 of the arms are cantilevered relatively rigidly outwardly from the relatively inboard body sections 28 at the junctures 38 between the respective body sections of the respective arms, so that the relatively outboard body sections 30 extend outwardly from the relatively inboard body sections 28 substantially along lines of projection that form acute angles with the perpendiculars interconnecting the respective stops 42 with the horizontal axis 40, and project to the relatively outboard side of the vertical plane of the horizontal axis 40 from the relatively inboard side thereof to the extent that the relatively outboard ends 36 of the arms are disposed on the relatively outboard side of the vertical plane of the horizontal axis 40 when the relatively inboard body sections 28 of the arms are in the relatively retracted position of the arm structure. The bridle 22 is suspended from the relatively outboard end portions 36 of the arms at points 50 in the planes of pivotal movement of the arms sufficiently spaced apart from the horizontal axis 40 that the relatively inboard pontoon 24 of the dinghy 14 remains spaced apart from the vertical plane of the horizontal axis 40, and on the relatively outboard side thereof, when firstly, the dinghy is suspended on the bridle at a level above the surface of the platform 8, and in a generally horizontal disposition with the inboard pontoon 24 thereof oriented toward the davit, and secondly, the relatively inboard body sections 28 of the arms are pivoted in arcs about the horizontal axis between positions in which the lines of projection of the relatively outboard body sections 30 of the arms coincide with horizontals in the planes of pivotal movement, and incline to the same at angles therebelow, respectively. See FIGS. 4 and 5. However, the relatively inboard pontoon 24 of the dinghy crosses the vertical plane of the horizontal axis 40 and alternately advances within and retracts from the recesses 48 of the swales 44 in the relatively inboard body sections 28 of the arms when those sections pivot in the arcs about the horizontal axis 40 between positions in which the lines of projection of the relatively outboard body sections 30 of the arms coincide with the horizontals of FIG. 4, and incline to the same at angles thereabove, respectively, as seen in FIGS. 2 and 3.

Preferably, as seen in FIG. 2, the points 50 of suspension of the bridle 22 are spaced apart from the horizontal axis 40 of the shoes 32 so that the relatively inboard pontoon 24 of the dinghy abuts the relatively inboard body sections 28 of the arms at the swales 44 thereof when the arms are in the relatively retracted position of the arm structure. Moreover, the bridle 22 preferably includes sets of crotch lines 52 that are attachable to the opposing end portions of the dinghy, at points spaced relatively fore and aft of the aforesaid points 50 of suspension, to suspend the dinghy in a generally horizontal disposition from the arm structure.

The arm structure 16 is swung inboard and outboard of the transom by means of a line 54 extending outboard from the transom 4 to a cross member 56 bridging between the pair of arms 26 at the axial ends of the arm structure. The line may be power operated, or simply wrapped about a cleat 58 and hand operated when it is desired to raise or lower the arm structure. Commonly, the line 54 is secured to the cross member 56 at a point disposed more adjacent the arm having the stern end portion of the dinghy 14 suspended therefrom, with any engine or other power unit 60 added to it, so that the greater weight of that end portion has the shorter distance to the line. See FIG. 6.

Often, the relatively outboard body sections 30 of the arms are flared in the respective fore and aft directions of the dinghy, as seen in FIG. 6, to give the points 50 of suspension of the bridle a greater separation.

Figure 7:
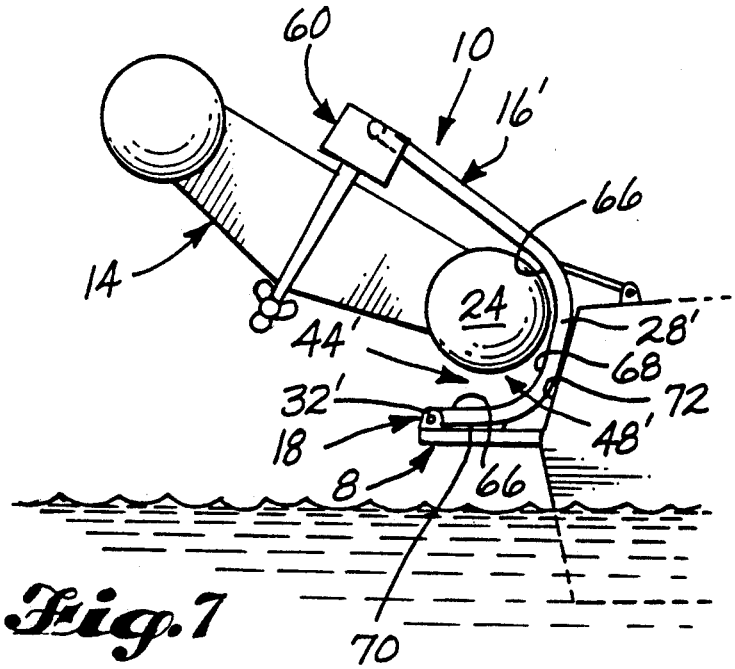
FIG. 7 is a part side elevational view of the assembly when a different version of the davit is in use, i.e., one having a swale with a wider intermediate wall at the bight thereof to space the side walls of the swale sufficiently apart from one another that the adjacent pontoon of the dinghy tends to mate more with one sidewall of the swale than the other.

The two versions of the davit seen in FIGS. 1–6, and FIG. 7, respectively, have common arms structures 16 in that the relatively inboard and outboard body sections of the arms of the structures form generally L-shaped configurations in which the relatively inboard body sections 28 are crooked to have generally U-shaped configurations, and the relatively outboard body sections 30 are generally straight to give the respective arms the necessary reach. However, in the case of the version seen in FIGS. 1–6, the generally opposing walls 62 at the opposing sides of the recesses 48 of the swales 44 in the arms, are spaced apart from one another in the planes of pivotal movement by intermediate walls 64 at the bights of the U's which correspond in width to the height of the relatively inboard pontoon 24 of the dinghy, so that the relatively inboard pontoon 24 substantially mates with both sidewalls 62 of the swales when the pontoon is advanced within the recesses of the swales; whereas in FIG. 7, the sidewalls 66 of the respective swales 44' are spaced apart from one another in the planes of pivotal movement by intermediate walls 68 at the bights of the U's which are substantially wider than the height of the relatively inboard pontoon 24 so that the pontoon tends to mate more with one sidewall of the swales than the other, i.e., the upper sidewall of each, when the pontoon is advanced within the recesses 48' of the swales. In the latter embodiment, moreover, the relatively inboard body sections 28' of the arms not only abut the heels 70 of the shoes 32' in the relatively retracted position of the arm structure 16', but in addition, the wall 72 of the transom itself, so as to add a further element of stability to the assembly when the yacht 2 is underway and reacting with the water. The heels 70 of the shoes are also considerably longer, as seen in FIG. 7, so as to provide a greater measure of contact between the arm structure 16' and the surface of the platform 8 when the arm structure is in the relatively retracted position thereof.

Of course, the respective versions of the davit 10 may be used in conjunction with a hatch or a hold, rather than one side of a vessel 2 as shown.

I claim:

1. In a davit that is operatively mounted on a generally horizontal surface of a marine vessel, adjacent an edge thereof, and operatively projected relatively outboard from the edge to raise and lower an object between positions relatively above and below the surface, said object having one laterally oriented side thereof adapted to be accommodated within an indentation in the peripheral outline of the davit, when the object is raised to a predetermined level above the surface of the vessel and suspended from the davit in a generally horizontal disposition with the one laterally oriented side thereof oriented toward the davit, an elongated arm structure, a base for supporting the arm structure on the surface of the vessel to pivot about an arc in the vertical plane coinciding with the longitudinal axis of the arm structure, a stop for defining one end of the arc of pivotal movement of the arm structure in the aforesaid vertical plane of the longitudinal axis thereof, and a bridle which is operable when the arm structure is at the one end of the arc, to suspend the object from the arm structure at the aforesaid level above the surface of the vessel, and in a generally horizontal disposition in which the one laterally oriented side of the object is oriented toward the arm structure transverse the plane of pivotal movement of the arm structure, the arm structure having a pair of first and second sections in the body thereof, which are relatively tandemly arranged along the length of the arm structure and disposed adjacent the opposing ends of the arm structure, with a juncture therebetween intermediate the ends of the arm structure, the first body section being disposed adjacent one end of the arm structure, and the one end portion of the arm structure being pivotally connected to the base so that the first body section is pivotally about a generally horizontal axis transverse the aforesaid vertical plane of the longitudinal axis of the arm structure, the stop being operatively disposed to limit the pivotal travel of the first body section to a relatively retracted position in which the first body section coincides with the perpendicular interconnecting the stop with the horizontal axis at one side of the vertical plane coinciding with the horizontal axis, the first body section having a relatively concave swale therein, the mouth of which is oriented to the other side of the vertical plane of the horizontal axis, and the recess of which is disposed within the peripheral outline of the arm structure to lie substantially entirely on the one side of the vertical plane of the horizontal axis and form the indentation in the peripheral outline of the davit when the first body section of the arm structure is disposed in the relatively retracted position thereof, the second body section being cantilevered relatively rigidly outwardly from the first body section at the juncture between the respective body sections, so that the second body section extends outwardly from the first body section substantially along a line of projection that forms an acute angle with the perpendicular interconnecting the stop with the horizontal axis, and projects to the other side of the vertical plane of the horizontal axis from the one side thereof to the extent that the other end of the arm structure is disposed on the other side of the vertical plane of the horizontal axis when the first body section is in the relatively retracted position thereof, and the bridle being suspended from the other end portion of the arm structure at a point in the plane of pivotal movement thereof sufficiently spaced apart from the horizontal axis that the aforesaid one laterally oriented side of the object remains spaced apart from the vertical plane of the horizontal axis and on the other side thereof, when the object is suspended on the bridle at the aforesaid level and in the aforesaid disposition, and the first body section is pivoted in an arc about the horizontal axis between positions in which the line of projection of the second body section coincides with a horizontal in the plane of pivotal movement, and inclines to the same at angles therebelow, respectively, but the aforesaid one laterally oriented side of the object crosses the vertical plane of the horizontal axis and alternately advances within and retracts from the recess of the swale in the first body section when the first body section is pivoted in the arc about the horizontal axis between positions in which the line of projection of the second body section coincides with the aforesaid horizontal in the plane of pivotal movement, and inclines to the same at angles thereabove, respectively.

2. The davit according to claim 1 wherein the point of suspension of the bridle is spaced apart from the horizontal axis so that the one laterally oriented side of the object abuts the first body section of the arm structure at the swale thereof when the arm structure is in the relatively retracted position thereof.

3. The davit according to claim 1 wherein the swale has a generally U-shaped cross section in the plane of pivotal movement of the arm structure, and generally opposing walls at the opposing sides of the recess of the swale, and the sidewalls of the swale are spaced apart from one another in the plane of pivotal movement by an intermediate wall at the bight of the U which corresponds in width to the height of the one side of the object so that the one side of the object substantially mates with both sidewalls of the swale when the one side of the object is advanced within the recess of the swale.

4. The davit according to claim 1 wherein the swale has a generally U-shaped cross section in the plane of pivotal movement of the arm structure, and generally opposing walls at the opposing sides of the recess of the swale, and the sidewalls of the swale are spaced apart from one another in the plane of pivotal movement by an intermediate wall at the bight of the U which is substantially wider than the height of the one side of the object so that the one side of the object tends to mate more with one sidewall of the swale than the other, when the one side of the object is advanced within the recess of the swale.

5. The davit according to claim 1 wherein the arm structure is also elongated along a parallel to the horizontal axis, to coextend with an object which is elongated along a parallel to the horizontal axis.

6. The davit according to claim 5 wherein the bridle includes a set of crotch lines which are attachable to the opposing end portions of the object, at points spaced apart from the aforesaid points of suspension, to suspend the object in a generally horizontal disposition from the arm structure.

7. The davit according to claim 5 wherein the arm structure comprises a pair of crooked arms which have first and second body sections apiece and are interconnected with one another in spaced parallel array at the opposing axial ends of the arm structure.

8. The davit according to claim 7 wherein the first and second body sections of each arm form a generally L-shaped configuration in which the first body section is crooked to have a generally U-shaped configuration, and the second body section is generally straight to give the respective arm the necessary reach.

9. The davit according to claim 7 wherein the base comprises a pair of spaced parallel shoes which have the first body sections of the respective arms pivotally interconnected therewith at a horizontal axis extending therebetween, and stops formed on the heels thereof at points spaced apart from the horizontal axis.

10. In combination, a marine vessel having a generally horizontal surface thereon, adjacent an edge thereof, a davit mounted on the surface of the vessel to operatively project relatively outboard from the edge and raise and lower an object between positions relatively above and below the surface, said object having one laterally oriented side thereof adapted to be accommodated within an indentation in the peripheral outline of the davit, when the object is raised to a predetermined level above the surface of the vessel and suspended from the davit in a generally horizontal disposition with the one laterally oriented side thereof oriented toward the davit, said davit having an elongated arm structure, a base for supporting the arm structure on the surface of the vessel to pivot about an arc in the vertical plane coinciding with the longitudinal axis of the arm structure, a stop for defining one end of the arc of pivotal movement of the arm structure in the aforesaid vertical plane of the longitudinal axis thereof, and a bridle which is operable when the arm structure is at the one end of the arc, to suspend the object from the arm structure at the aforesaid level above the surface of the vessel, and in a generally horizontal disposition in which the one laterally oriented side of the object is oriented toward the arm structure transverse the plane of pivotal movement of the arm structure, the arm structure having a pair of first and second sections in the body thereof, which are relatively tandemly arranged along the length of the arm structure and disposed adjacent the opposing ends of the arm structure, with a juncture therebetween intermediate the ends of the arm structure, the first body section being disposed adjacent one end of the arm structure, and the one end portion of the arm structure being pivotally connected to the base so that the first body section is pivotable about a generally horizontal axis transverse the aforesaid vertical plane of the longitudinal axis of the arm structure, the stop being operatively disposed to limit the pivotal travel of the first body section to a relatively retracted position in which the first body section coincides with the perpendicular interconnecting the stop with the horizontal axis at one side of the vertical plane coinciding with the horizontal axis, the first body section having a relatively concave swale therein, the mouth of which is oriented to the other side of the vertical plane of the horizontal axis, and the recess of which is disposed within the peripheral outline of the arm structure to lie substantially entirely on the one side of the vertical plane of the horizontal axis and form the indentation in the peripheral outline of the davit when the first body section of the arm structure is disposed in the relatively retracted position thereof, the second body section being cantilevered relatively rigidly outwardly from the first body section at the juncture between the respective body sections, so that the second body section extends outwardly from the first body section substantially along a line of projection that forms an acute angle with the perpendicular interconnecting the stop with the horizontal axis, and projects to the other side of the vertical plane of the horizontal axis from the one side thereof to the extent that the other end of the arm structure is disposed on the other side of the vertical plane of the horizontal axis when the first body section is in the relatively retracted position thereof, and the bridle being suspended from the other end portion of the arm structure at a point in the plane of pivotal movement thereof sufficiently spaced apart from the horizontal axis that the aforesaid one laterally oriented side of the object remains spaced apart from the vertical plane of the horizontal axis and on the other side thereof, when the object is suspended on the bridle at the aforesaid level and in the aforesaid disposition, and the first body section is pivoted in an arc about the horizontal axis between positions in which the line of projection of the second body section coincides with a horizontal in the plane of pivotal movement, and inclines to the same at angles therebelow, respectively, but the aforesaid one laterally oriented side of the object crosses the vertical plane of the horizontal axis and alternately advances within and retracts from the recess of the swale in the first body section when the first body section is pivoted in the arc about the horizontal axis between positions in which the line of projection of the second body section coincides with the aforesaid horizontal in the plane of pivotal movement, and inclines to the same at angles thereabove, respectively.

11. The combination according to claim 10 wherein the point of suspension of the bridle is spaced apart from the horizontal axis so that the one laterally oriented side of the object abuts the first body section of the arm structure at the swale thereof when the arm structure is in the relatively retracted position thereof.

12. The combination according to claim 11 wherein the arm structure abuts a second surface of the vessel which is relatively upstanding on the first mentioned surface of the vessel, at a distance from the horizontal axis, when the one side of the object abuts the first body section of the arm structure in the relatively retracted position thereof.

13. The combination according to claim 1 wherein the arm structure is also elongated along a parallel to the horizontal axis, to coextend with an object which is elongated along a parallel to the horizontal axis.

14. The combination according to claim 13 wherein the bridle includes a set of crotch lines which are attachable to the opposing end portions of the object, at points spaced apart from the aforesaid points of suspension, to suspend the object in a generally horizontal disposition from the arm structure.

15. The combination according to claim 13 wherein the arm structure comprises a pair of crooked arms which have first and second body sections apiece and are interconnected with one another in spaced parallel array at the opposing axial ends of the arm structure.

16. The combination according to claim 15 wherein the first and second body sections of each arm form a generally L-shaped configuration in which the first body section is crooked to have a generally U-shaped configuration, and the second body section is generally straight to give the respective arm the necessary reach.

17. The combination according to claim 15 wherein the base comprises a pair of spaced parallel shoes which have the first body sections of the respective arms pivotally interconnected therewith at a horizontal axis extending therebetween, and stops formed on the heels thereof at points spaced apart from the horizontal axis.

18. The combination according to claim 15 wherein the vessel has a swim platform extending across the stern thereof, below the transom thereof, and the davit is mounted on the top surface of the swim platform.

19. The combination according to claim 18 further comprising means for swinging the arm structure inboard and outboard of the transom, including a line extending outboard from the transom to a cross member bridging between the pair of arms at the axial ends of the arm structure.

20. The combination according to claim 19 wherein the transom has a cleat thereon, about which the line can be hand wrapped to tether the arm structure to the same in the relatively retracted position thereof.

* * * * *